United States Patent [19]

Graves

[11] Patent Number: 4,583,864

[45] Date of Patent: Apr. 22, 1986

[54] SOLAR SYSTEM CLOCK

[76] Inventor: Joseph R. Graves, 2132 Second Ave., Apt. 505, Seattle, Wash. 98121

[21] Appl. No.: 732,747

[22] Filed: May 10, 1985

[51] Int. Cl.[4] ..... G04B 19/26

[52] U.S. Cl. ..... 368/17; 368/16; 368/229

[58] Field of Search ..... 368/16, 17, 18, 23, 368/229

[56] References Cited

U.S. PATENT DOCUMENTS

| | | | |
|---|---|---|---|
| 167,138 | 8/1875 | Troll | 368/16 |
| 1,153,492 | 9/1915 | Hoitinga | 368/16 |
| 1,416,605 | 5/1922 | Bulka | 368/16 |
| 1,750,505 | 3/1930 | Bulka | 368/16 |
| 2,943,435 | 7/1960 | Gorsuch | 368/18 |
| 3,183,659 | 5/1965 | Etienne | 368/238 |
| 3,766,727 | 10/1973 | Didik | 368/15 |
| 4,334,297 | 6/1982 | Oros | 368/18 |

*Primary Examiner*—Bernard Roskoski
*Attorney, Agent, or Firm*—Norman B. Rainer

[57] ABSTRACT

A novelty clock is provided wherein a spherical representation of the earth rotates about the face of the clock as would a second hand. While rotating about the face of the clock, the earth also rotates upon its own axis, thereby providing a more realistic and appealing visual effect. The special motion of the earth is achieved by a motion producing mechanism driven by the rotational force of the shaft which ordinarily drives the second hand of the clock.

9 Claims, 4 Drawing Figures

SOLAR SYSTEM CLOCK

BACKGROUND OF THE INVENTION

This invention relates to a clock, and more particularly to a clock whose face is provided with a centered representation of the sun and a sphere which represents earth and rotates about the face with movement of the time-indicating hands.

Conventional techniques for displaying time are well known to all and include numerical displays, rotating hands, and the like. Clocks which further provide moving displaYs for educational purposes or visual attractiveness are also well known. The depiction of aspects of the solar system on clock faces has been disclosed, but such clocks are either of complex construction or involve minimal movement of the visually attractive components.

It is accordingly an object of the present invention to provide a clock which depicts movement of the earth around the sun.

It is a further object of the invention to provide a clock as in the foregoing object wherein the earth is represented by a sphere which undergoes axial rotation while undergoing orbital motion around the sun.

It is another object of the present invention to provide a clock of the aforesaid nature amenable to economical manufacture by way of simple modification of clocks of conventional design.

These objects and other objects and advantages of the invention will be apparent from the following description.

SUMMARY OF THE INVENTION

The above and other beneficial ohjects and advantages are accomplished in accordance with the present invention by a clock comprising:

(a) a timing mechanism, (b) a generally flat circular face, (c) coaxial drive shafts centrally positioned in said face and rotated by said timing mechanism to accommodate hour, minute and second hands, (d) a transparent cover mounted upon said face in spaced apart relationship therewith, said cover having interior and exterior surfaces, (e) an opaque representation of the sun centrally affixed to said cover, and (f) a motion producing mechanism comprising:

(1) a first axle representing an extension of the drive shaft intended to drive a second hand, and having a distal extremity positioned adjacent the center of said cover, (2) a second axle perpendicularly mounted to said first axle in parallel disposition to said face and adapted to rotate about its axis of elongation, and terminating in a radially outermost extremity located radially beyond the sun, (3) a substantially spherical representation of earth affixed to the outermost extremity of said second axle, (4) moving gear means mounted upon said second axle in perpendicular disposition to said face, (5) stationary gear means affixed to the interior surface of the cover in annular relationship to the center thereof, and adapted to engage and rotate said moving gear means, and (6) bearing means centrally associated with the interior surface of the cover and adapted to support the distal extremity of said first axle, whereby (7) movement of the shaft intended to drive a second hand rotates the earth in a circular path around the sun and simultaneously produces axial rotation of the earth.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
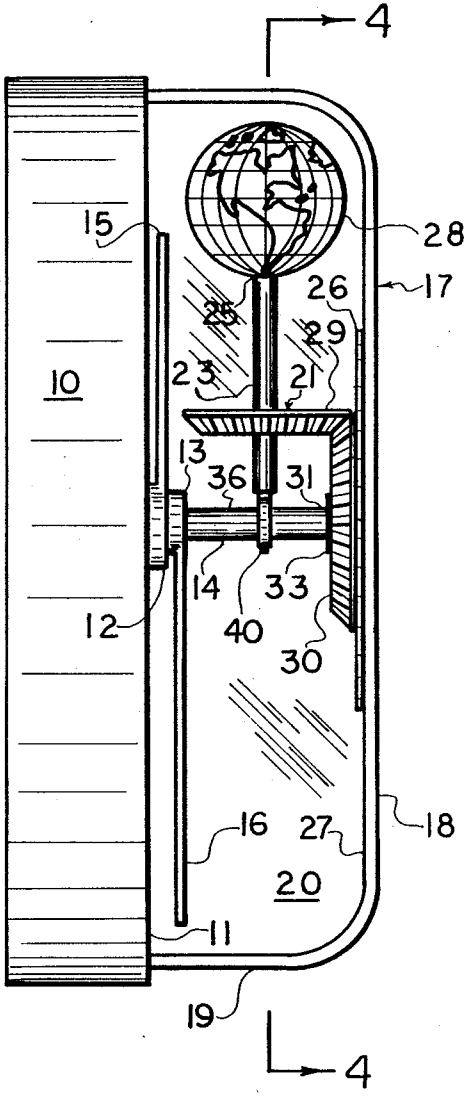
FIG. 1 is a side view of an embodiment of the clock of the invention

For convenience in description, the terms "interior" or words of similar import will have reference to the interior of the region bounded by the clock face and cover as shown in FIG. 1. The expressions "forward" and "rearward" and equivalents thereof will have reference to locations adjacent the cover and face, respectively.

DESCRIPTION OF THE PREFERRED EMBODIMENT

Referring to FIG. 1, a clock of the present invention is shown comprised of housing 10 which encloses a timing mechanism of conventional design driven preferably by an electrical motor, a time-indicating flat face 11 of circular perimeter forwardly enclosing said timing mechanism and provided with conventional time-indicating indicia, and concentric drive shafts 12, 13 and 14 extending from the timing mechanism through the center of said face and adapted to drive the hour, minute and second hands, respectively. Hour hand 15 and minute hand 16 are attached to their respective drive shafts. Drive shaft 14 in the embodiment illustrated in FIG. 1 is forwardly elongated to an extent not ordinarily encountered in clocks of conventional design, and thereby constitutes a first axle 36 capable of specialized functionality. A conventional second hand is not associated with shaft 14.

A transparent integral cover 17 comprised of flat forward panel 18 and encircling sidewall 19 is affixed to the clock in front of face 11, forming a protective enclosure 20. An opaque flat representation of the sun 26 is centrally affixed to the interior surface 27 of panel 18.

Figure 4:
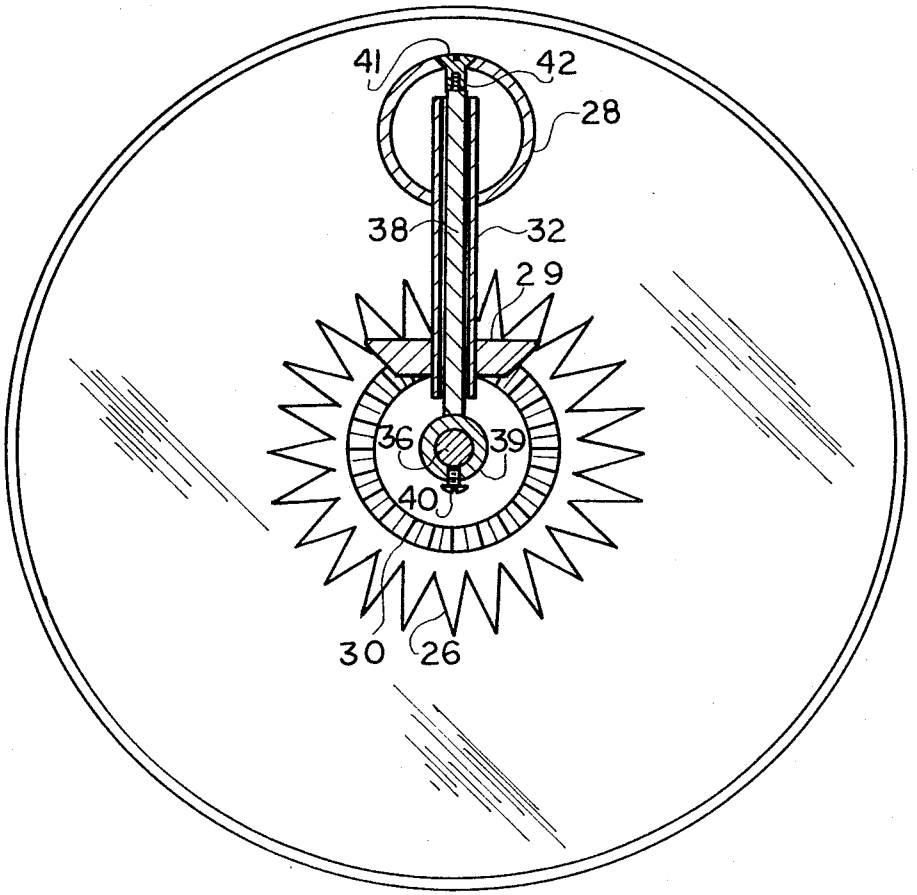
FIG. 4 is a sectional view taken along the line 4—4 of FIG. 1.

A motion producing mechanism 21, driven by drive shaft 14 intended for a second hand, is confined within enclosure 20. In said motion producing mechanism, first axle 36 extends outwardly from face 11 as an extension of the drive shaft intended to drive a second hand, and terminates in a distal extremitv 31 located adjacent forward panel 18 of cover 17. The axis of elongation of said first axle passes through the centers of face 11 and forward panel 18. A second axle 23 adapted to rotate about its own axis of elongation, is perpendicularly mounted to said first axle in parallel disposition to said face. As shown more clearly in FIGS. 2 and 4, the exemplified embodiment of axle 23 is in the form of a tube 32 which mounts upon post 38 attached to positioning collar 39 which engages axle 36. A set screw 40 fixes the location of said collar along said axle. The distal outermost extremity 25 of tube 32 is attached to a substantially spherical representation of earth 28 located radially beyond the sun 26. The assembly of said tube 32 and earth 28 is held onto post 38 by means of cap bolt 41 adapted to engage the threaded distal extremity 42 of post 38.

A moving gear in the form of bevel gear 29 is perpendicularly mounted upon tube 32. A stationary gear, in the form of bevel gear 30, is adhered to the sun on the interior surface of forward panel 18 in annular relationship to the center thereof, and is adapted to engage and rotate said moving gear. In other embodiments, said moving and stationary gears may be pinion and crown gears or mechanisms of equivalent alternative design permitting the sought functional interaction.

Bearing means in the form of bushing 33, adapted to rotatively support distal extremity 31 of said first axle, is fixedly centered within said stationary gear. The bearing means may be integral with the stationary gear or separately fastened to the sun on the interior surface of forward panel 18.

Figure 3:
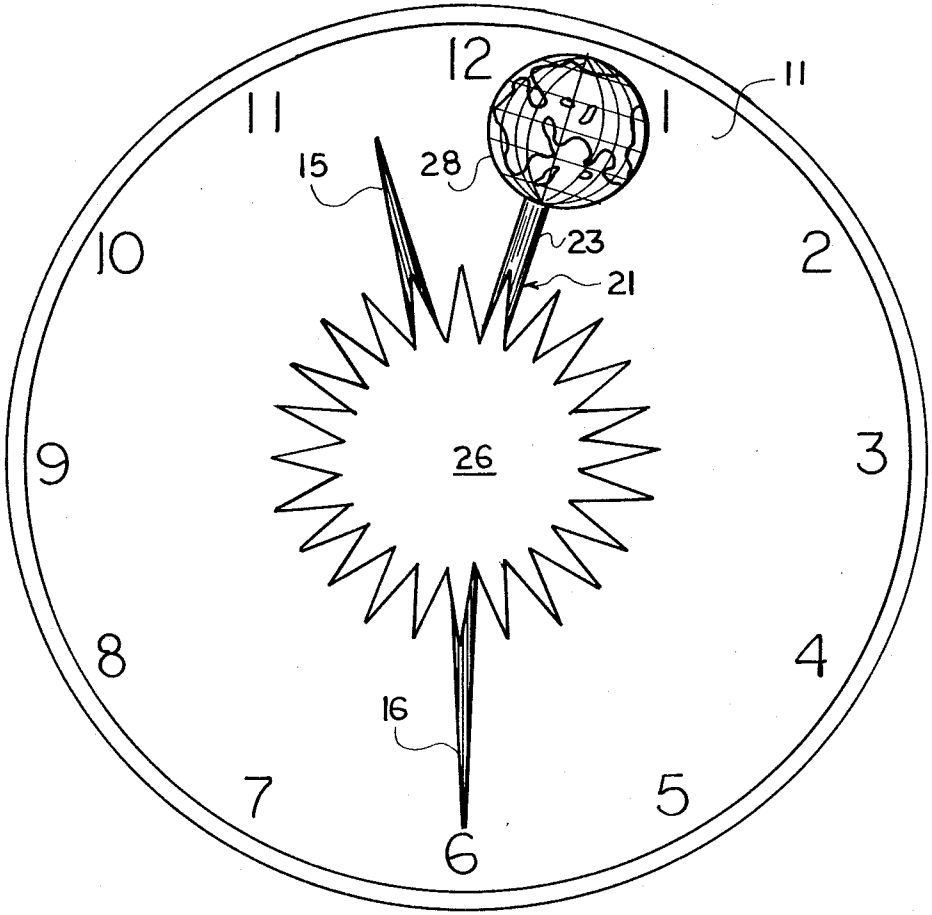
FIG. 3 is a front view of the clock of FIG. 1.

By virtue of the aforesaid construction of the motion producing mechanism, when the drive shaft for the second hand is turned by the timing mechanism, the earth moves in a circular orbital path around the sun and simultaneously rotates upon its own axis. Such two-fold motion is educationally realistic and further serves as a visually attractive display. As best shown in FIG. 3, the diameter of the sun is large enough to obscure the underlying motion producing mechanism.

Figure 2:
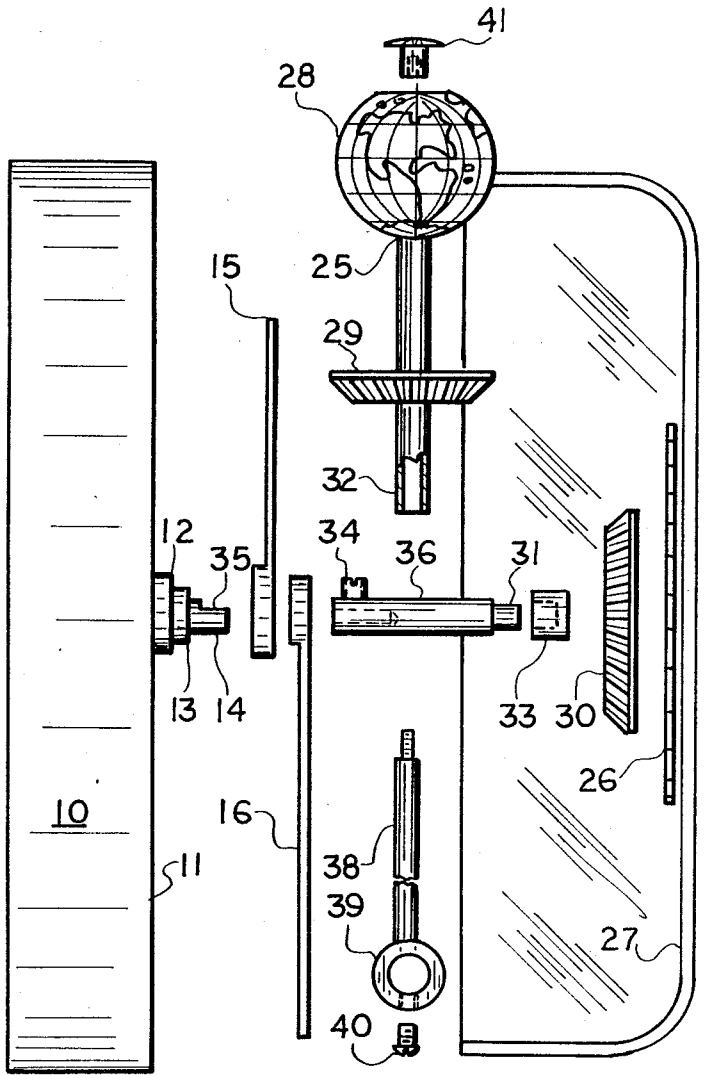
FIG. 2 is a fragmentary exploded side view of an alternative embodiment of the clock of this invention.

In the alternative embodiment of the clock of this invention shown in FIG. 2, first axle 36 is not an integral extension of the drive shaft for the second hand. Instead, the axle, in the form of a hollow tube, is attached by set screw 34 to the extremity of drive shaft 14 which is filed down to produce a flat shoulder 35 capable of accommodating the set screw.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A clock comprising (a) a timing mechanism, (b) a generally flat circular face, (c) coaxial drive shafts centrally positioned in said face and rotated by said timing mechanism to accommodate hour, minute and second hands, (d) a transparent cover mounted upon said face in spaced apart relationship therewith, said cover having a substantially flat forward panel having interior and exterior surfaces, (e) an opaque representation of the sun centrally affixed to said forward panel, and (f) a motion producing mechanism comprising:

(1) a first axle representing an extension of the drive shaft intended to drive a second hand, and having a distal extremity positioned adjacent the center of said forward panel, (2) a second axle perpendicularly mounted to said first axle in parallel disposition to said face and adapted to rotate about its own axis of elongation, and terminating in a radially outermost extremity located radially beyond the sun, (3) a substantially spherical representation of earth affixed to the outermost extremity of said second axle, (4) moving gear means mounted upon said second axle in perpendicular disposition to said face, (5) stationary gear means affixed to the interior surface of said forward panel in annular relationship to the center thereof, and adapted to engage and rotate said moving gear means, and (6) bearing means centrally associated with the interior surface of said forward panel and adapted to support the distal extremity of said first axle, whereby (7) movement of the shaft intended to drive a second hand rotates the earth in a circular path around the sun and simultaneously produces axial rotation of the earth.

2. The clock of claim 1 wherein said timing mechanism is electrically driven.

3. The clock of claim 2 wherein said circular face forwardly encloses said timing mechanism, and is provided with conventional time-indicating indicia.

4. The clock of claim 1 wherein said transparent cover is further comprised of a sidewall which encircles said forward panel in substantially perpendicular disposition thereto

5. The clock of claim 4 wherein said sidewall attaches to the circular face, thereby forming a protective enclosure bounded by said face, forward panel and sidewall.

6. The clock of claim 5 wherein said motion producing mechanism is housed within said protective enclosure.

7. The clock of claim 1 wherein said second axle is adjustably positionable along said first axle.

8. The clock of claim 1 wherein the sun is of sufficiently large diameter to obscure said motion producing mechanism.

9. The clock of claim 1 wherein said first axle attaches to said drive shaft for a second hand.

* * * * *